US011655592B2

(12) United States Patent
Tsai

(10) Patent No.: US 11,655,592 B2
(45) Date of Patent: May 23, 2023

(54) LIQUID APPLYING APPARATUS FOR FIBER PRODUCTS

(71) Applicant: CHAN LI MACHINERY CO., LTD., Taoyuan (TW)

(72) Inventor: Tung-I Tsai, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 91 days.

(21) Appl. No.: 17/232,549

(22) Filed: Apr. 16, 2021

(65) Prior Publication Data

US 2022/0081838 A1 Mar. 17, 2022

(30) Foreign Application Priority Data

Sep. 11, 2020 (TW) ..... 109131292

(51) Int. Cl.

| | |
|---|---|
| ***D21F 11/08*** | (2006.01) |
| ***B05C 1/08*** | (2006.01) |
| ***D21H 23/56*** | (2006.01) |
| ***D21H 27/34*** | (2006.01) |

(52) U.S. Cl.

CPC ..... *D21F 11/08* (2013.01); *B05C 1/0834* (2013.01); *D21H 23/56* (2013.01); *D21H 27/34* (2013.01)

(58) Field of Classification Search

CPC ..... B05D 2203/00; B05D 2203/22; B05D 2252/02; B05D 2252/10; B05D 1/28; B05C 1/0834; B05C 1/083; D21H 23/56; D21H 27/34; D21H 27/30; D21F 11/08

See application file for complete search history.

(56) References Cited

U.S. PATENT DOCUMENTS 1,908,275 A * 5/1933 John ..... D21H 23/56 118/118
2,293,690 A * 8/1942 Harrigan ..... D21H 23/56 427/428.15

(Continued)

FOREIGN PATENT DOCUMENTS

CN 114599258 A * 6/2022 ..... D21H 17/06
EP 3967809 A1 * 3/2022 ..... B05C 1/08

(Continued)

OTHER PUBLICATIONS

Communication From the European Patent Office Regarding a Counterpart Foreign Application dated Oct. 20, 2021.

*Primary Examiner* — Jose A Fortuna
(74) *Attorney, Agent, or Firm* — Rosenberg, Klein & Lee

(57) ABSTRACT

A liquid applying apparatus for fiber products is provided, including a first liquid applying device, a second liquid applying device, and a third liquid applying device. The second liquid applying device is adjacent to the first liquid applying device and the third liquid applying device. The first liquid applying device and the second liquid applying device respectively apply and coat liquids on different surfaces of a two-layer fiber product, and the third liquid applying device applies and coats a liquid on a surface of a single-layer fiber product. The second liquid applying device and the third liquid applying device press and laminate the two-layer fiber product and the single-layer fiber product together to form a three-layer fiber product with uniformly distributed liquids therein.

3 Claims, 1 Drawing Sheet

(56) References Cited

U.S. PATENT DOCUMENTS 2,676,563 A * 4/1954 Montgomery ..... D21H 23/56 118/227
2,946,307 A * 7/1960 Warner ..... D21H 23/56 118/223
3,024,129 A * 3/1962 Brundige ..... D21H 5/0067 427/364
3,308,751 A * 3/1967 Junji ..... B41F 13/02 101/178
4,853,255 A * 8/1989 Onishi ..... B41M 5/0011 427/428.12
4,973,441 A * 11/1990 Keller ..... D21H 25/14 427/361
4,980,207 A * 12/1990 Sollinger ..... D21H 23/60 118/414
5,340,611 A * 8/1994 Kustermann ..... B05C 11/025 427/361
5,607,553 A * 3/1997 Chadha ..... D21G 1/00 427/209
5,720,913 A * 2/1998 Andersen ..... B29C 45/0013 264/108
5,938,895 A * 8/1999 Hirvonen ..... D21F 7/003 100/163 A
5,944,898 A 8/1999 Mendez
6,203,858 B1 * 3/2001 Plomer ..... B05C 1/0813 118/316
6,280,574 B1 * 8/2001 Bauer ..... D21G 1/0093 162/266
6,881,301 B2 * 4/2005 Heikkinen ..... D21G 1/0093 162/204
7,419,570 B2 * 9/2008 Chen ..... D21H 25/005 162/134
8,425,721 B2 * 4/2013 Tynkkynen ..... D21G 1/0093 427/361
10,036,124 B2 * 7/2018 Skaggs ..... D21H 23/56
10,280,567 B2 * 5/2019 Vogt ..... D21F 11/006
10,538,882 B2 * 1/2020 LeBrun ..... B32B 5/028
2005/0224200 A1 * 10/2005 Bouchard ..... B31F 1/07 162/158
2006/0194004 A1 8/2006 Niemoller et al.
2009/0324980 A1 * 12/2009 Matsushima ..... D21H 19/82 427/211
2012/0111516 A1 * 5/2012 Tynkkynen ..... D21H 23/50 162/266
2012/0156447 A1 * 6/2012 Hein ..... D21H 27/02 156/219
2013/0189457 A1 * 7/2013 Skaggs ..... D21H 23/22 427/158
2020/0094604 A1 * 3/2020 Singh ..... D21H 19/54
2022/0042246 A1 * 2/2022 Everett ..... D21H 13/06
2022/0081838 A1 * 3/2022 Tsai ..... D21H 23/56

FOREIGN PATENT DOCUMENTS

GB 2225554 A 6/1990
JP 2022047486 A * 3/2022 ..... B05C 1/08

* cited by examiner

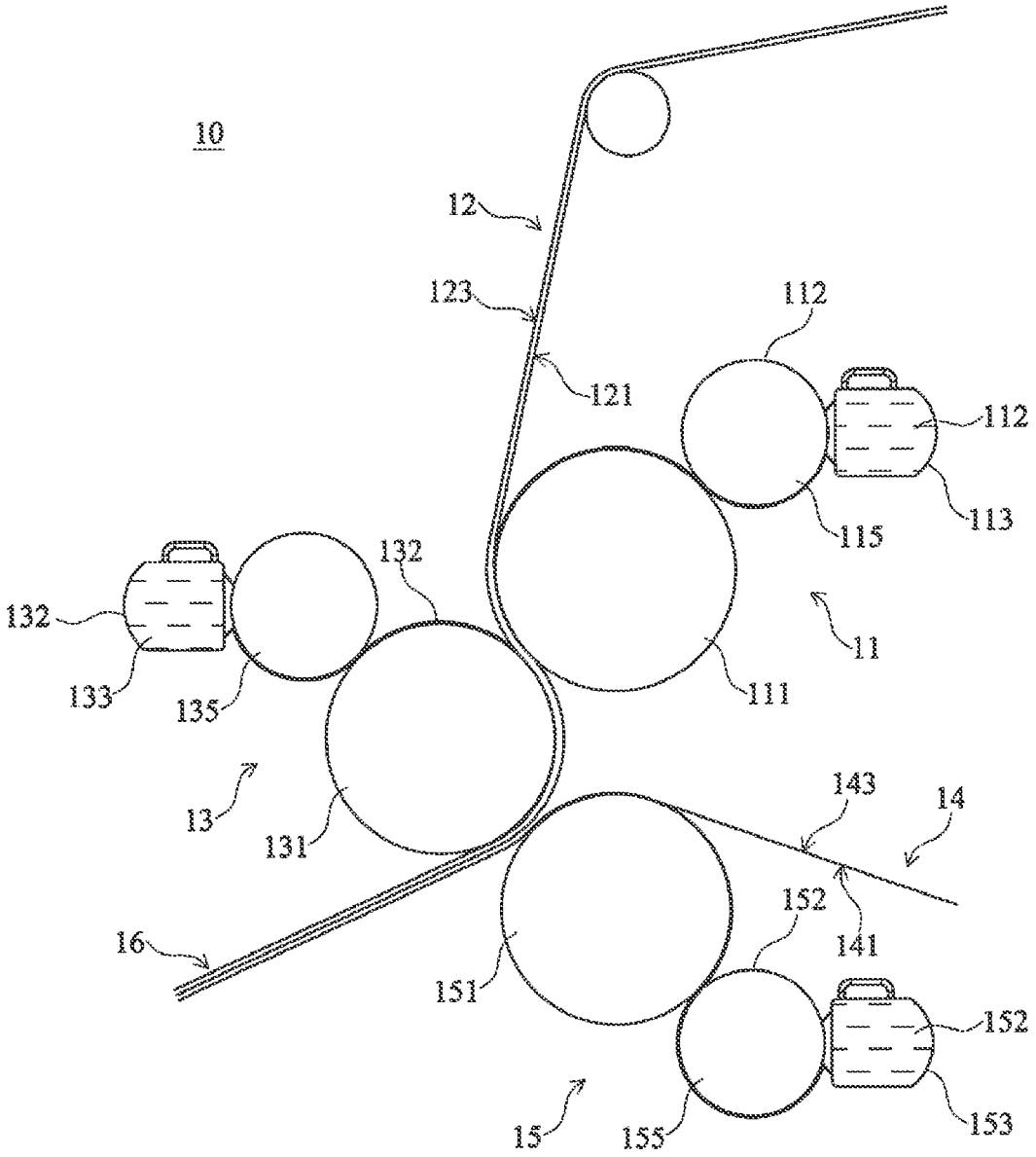
10
12
123
121
112
112
113
115
11
111
132
132
133
135
13
131
143
14
141
152
16
151
152
153
15
155

LIQUID APPLYING APPARATUS FOR FIBER PRODUCTS

BACKGROUND OF THE INVENTION

1. Field of the Invention

The present invention relates to a liquid applying apparatus for coating at least one liquid onto fiber products, such that the liquid is uniformly distributed on the fiber products that are of a three-layer structure.

2. The Related Arts

Toilet paper provides uses of water absorption and cleaning and is commonly used in daily living. Interfold tissues currently available in the market have a typical two-layer structure. However, three-layer tissues are now prevailing as they are more comfortable to users.

Further, some manufacturers produce tissue paper or nonwovens with liquid coated thereon, and examples are wet tissues or wet napkins to allow a user to wipe or clean articles. Toilet paper or nonwoven may be coated with various liquids, such as water, liquid disinfectant, and alcohol. A user may wipe hands with a piece of wet tissue or wet napkin for disinfection purposes.

SUMMARY OF THE INVENTION

The present invention provides a liquid applying apparatus for fiber products, which helps alleviate the issue of non-uniform coating in applying a liquid to a fiber product having three or more than three plies, and also helps improve efficiency of production.

An objective of the present invention is to provide a liquid applying apparatus for fiber products, which is operable to coat a liquid on a surface of each single ply of a fiber product having a three-layer structure so as to achieve uniform application of the liquid in the three-layer fiber product.

An objective of the present invention is to provide a liquid applying apparatus for fiber products, which includes three liquid applying devices, of which two are operable to apply a liquid to different surfaces of a two-layer fiber product, while the remaining one is operable to apply a liquid on a surface of a single-layer fiber product, the two-layer fiber product and the single-layer fiber product being subsequently stacked and adhesively bonded to make a three-layer fiber product, such that application of the liquid is made uniform in the three-layer fiber product.

An objective of the present invention is to provide a liquid applying apparatus for fiber products, which includes three liquid applying devices that are operable for individually adjusting the amounts of liquids applied to surfaces of a two-layer fiber product and a single-layer fiber product, so as to make the liquid uniformly distributed in a three-layer fiber product and also to facilitates minute adjustment the liquid amounts applied to the three-layer fiber product.

An objective of the present invention is to provide a liquid applying apparatus for fiber products, which includes three liquid applying devices that are operable for respectively applying different liquids on a fiber product in order to vary formula, smell, effect of disinfection, and color of the liquid applied to the fiber product.

To achieve the above objectives, the present invention provides a liquid applying apparatus for fiber products, comprising: a first liquid applying device including a first liquid application roller that is operable to coat a first liquid on a first surface of a first fiber product; a second liquid applying device including a second liquid application roller that is adjacent to the first liquid application roller, wherein the first fiber product is movable to pass between the first liquid application roller and the second liquid application roller, and the second liquid application roller is operable to coat a second liquid on a second surface of the first fiber product; and a third liquid applying device including a third liquid application roller that is adjacent to the second liquid application roller, the third liquid application roller being operable to coat a third liquid on a first surface of a second fiber product. The first fiber product and the second fiber product pass between the second liquid application roller and the third liquid application roller and are pressed and laminated by the second liquid application roller and the third liquid application roller. The first fiber product is a multi-layer fiber product and the second fiber product is a single-layer fiber product.

In the above liquid applying apparatus, the first liquid applying device comprises a first liquid tank and a first liquid pick-up roller, the first liquid pick-up roller being located between the first liquid application roller and the first liquid tank; the second liquid applying device comprises a second liquid tank and a second liquid pick-up roller, the second liquid pick-up roller being located between the second liquid application roller and the second liquid tank; and the third liquid applying device comprises a third liquid tank and a third liquid pick-up roller, the third liquid pick-up roller being located between the third liquid application roller and the third liquid tank.

Preferably, the first liquid pick-up roller, the second liquid pick-up roller, and the third liquid pick-up roller each has a surface that is formed with a plurality of concave portions thereon.

Preferably, the first liquid application roller, the second liquid application roller, and the third liquid application roller are each a rubber roller.

Preferably, the first liquid, the second liquid, and the third liquid have an identical formula.

Preferably, the first fiber product and the second fiber product are laminated and pressed together to form a third fiber product.

Preferably, the first fiber product is a two-layer fiber product, and the third fiber product is a three-layer fiber product.

Preferably, the second liquid application roller is located between the first liquid application roller and the third liquid application roller.

BRIEF DESCRIPTION OF THE DRAWINGS

The FIGURE is a schematic view illustrating a liquid applying apparatus for fiber products according to an embodiment of the present invention.

DETAILED DESCRIPTION OF THE PREFERRED EMBODIMENTS

Referring to the FIGURE, a schematic view is provided to illustrate a liquid applying apparatus for fiber products according to an embodiment of the present invention. As shown in the drawing, the liquid applying apparatus10 is operable to apply at least one liquid on a fiber product, and mainly comprises a first liquid applying device 11, a second liquid applying device 13, and a third liquid applying device 15. The second liquid applying device 13 is adjacent to each of the first liquid applying device 11 and the third liquid applying device 15, and the first liquid applying device 11 and the third liquid applying device 15 are not in direct contact with each other.

The first liquid applying device 11 comprises a first liquid application roller 111, and the second liquid applying device 13 comprises a second liquid application roller 131, wherein the second liquid application roller 131 is adjacent to the first liquid application roller 111. A first fiber product 12 is movable to pass between the first liquid application roller 111 and the second liquid application roller 131, wherein the first liquid application roller 111 is operable to apply a first liquid 112 on a surface of the first fiber product 12, such as a first surface 121, and the second liquid application roller 131 is operable to apply a second liquid 132 on another surface of the first fiber product 12, such as a second surface 123.

The third liquid applying device 15 comprises a third liquid application roller 151, wherein the second liquid application roller 131 is adjacent to the third liquid application roller 151, and the third liquid application roller 151 is operable to apply a third liquid 152 on a surface of a second fiber product 14. The first fiber product 12 and the second fiber product 14 are moved to pass between the second liquid application roller 131 and the third liquid application roller 151. The second liquid application roller 131 and the third liquid application roller 151 are operable to press the first fiber product 12 and the second fiber product 14 together, as being laminated, so as to form a third fiber product 16.

The first liquid 112, the second liquid 132, and the third liquid 152 can be liquids of identical or different formulas or compositions. For example, the first liquid 112, the second liquid 132, and the third liquid 152 can each be selected as one of an emulsion, a disinfectant agent, perfume, water, a moisturizer, and a cleaning agent, or the likes.

In an embodiment of the present invention, the first liquid applying device 11 further comprises a first liquid tank 113, which contains and stores therein the first liquid 112, wherein the first liquid 112 contained in the first liquid tank 113 is transferred to a surface of the first liquid application roller 111 and consequently, the first liquid application roller 111 applies the first liquid 112 to the first surface 121 of the first fiber product 12.

In a preferred embodiment of the present invention, the first liquid applying device 11 further comprises a first liquid pick-up roller 115, wherein the first liquid pick-up roller 115 is located between the first liquid tank 113 and the first liquid application roller 111. The first liquid pick-up roller 115 is set in contact with the first liquid tank 113, such that when the first liquid pick-up roller 115 is rotate relative to the first liquid tank 113, the first liquid 112 contained in the first liquid tank 113 is transferred to a surface of the first liquid pick-up roller 115. Further, the first liquid pick-up roller 115 is also set in contact with the first liquid application roller 111, so that the first liquid 112 on the surface of the first liquid pick-up roller 115 is transferred to the first liquid application roller 111. In a different embodiment, there can be multiple first liquid pick-up rollers 115.

The first liquid pick-up roller 115 and the first liquid application roller 111 are each of a cylindrical form, wherein the first liquid pick-up roller 115 is made of a material that is essentially not deformable and the surface of the first liquid pick-up roller 115 is formed with a plurality of concave portions. For example the first liquid pick-up roller 115 may be a metal mesh roller. The concave portions of the first liquid pick-up roller 115 may receive and hold and, thus, transfer the first liquid 112. The first liquid application roller 111 is made of a material that is deformable, for example the first liquid application roller 111 being a rubber roller, in order to assist the first liquid application roller 111 to apply and thus coat the first liquid 112 on the first surface 121 of the first fiber product 12.

The second liquid applying device 13 and the third liquid applying device 15 are each of a structure that is generally identical to or similar to that of the first liquid applying device 11. The second liquid applying device 13 comprises a second liquid application roller 131, a second liquid tank 133, and/or a second liquid pick-up roller 135, wherein the second liquid pick-up roller 135 is located between the second liquid tank 133 and the second liquid application roller 131, and the second liquid application roller 131 is operable to apply and thus coat the second liquid 132 on the second surface 123 of the first fiber product 12.

The third liquid applying device 15 comprises a third liquid application roller 151, a third liquid tank 153, and/or a third liquid pick-up roller 155, wherein the third liquid pick-up roller 155 is located between the third liquid tank 153 and the second liquid application roller 151, and the third liquid application roller 151 is operable to apply and thus coat the third liquid 152 on a first surface 141 of the second fiber product 14.

Specifically, the first fiber product 12 is a multi-layer fiber product and comprises a lamination of a plurality of single-layer fiber products, and therefore the first fiber product 12 has a thickness that is greater than a thickness of one single-layer fiber product. If liquid is applied to one signal surface of the first fiber product 12, the liquid may not uniformly penetrate and spread to every part the first fiber product 12. Further, in the course of application of the liquid to the first fiber product 12, it takes time to allow the liquid to penetrate, in a very slow manner, into the interior of the first fiber product 12, and this would increase the time necessary for finishing coating of the liquid.

For such problems, the present invention provides an arrangement in which the first liquid applying device 11 and the second liquid applying device 13 are operably to separately and individually apply and thus coat the first liquid 112 and the second liquid 132 on the different surfaces, such as opposite sides, of the first fiber product 12, such surface being the first surface 121 and the second surface 123 discussed above. The first liquid 112 and the second liquid 132 respectively penetrate through such different surfaces into the interior of the first fiber product 12, so that the first liquid 112 and the second liquid 132 can spread uniformly to every part of the first fiber product 12 and the time required for the liquids (the first liquid 112 and the second liquid 132) to penetrate into the interior of the first fiber product 12 can be shortened.

The third liquid applying device 15 is operable to apply and thus coat the third liquid 152 on a surface of the second fiber product 14, wherein the second fiber product 14 is a single-layer fiber product. The second fiber product 14 generally has a thickness that is smaller than the thickness of the first fiber product 12. Thus, one single third liquid applying device 15 suffices to make the third liquid 152 uniformly and quickly penetrate into an interior of the second fiber product 14.

The third liquid applying device 15 conveys the second fiber product 14 that has been coated as noted above to the second liquid applying device 13, such that the second fiber product 14 is stacked on and laminated with the first fiber product 12. Specifically, the third liquid applying device 15 is operable to apply and thus coat the third liquid 152 on the first surface 141 of the second fiber product 14, and a second surface 143 of the second fiber product 14 is set in contact with and bonded to the first surface 121 of the first fiber product 12, such that the first fiber product 12 and the second fiber product 14 are stacked and laminated together to form the third fiber product 16.

Further, the second liquid application roller 131 of the second liquid applying device 13 and the third liquid application roller 151 of the third liquid applying device 15 are set adjacent to each other to press and thus laminate the stacked first fiber product 12 and second fiber product 14, such that the first fiber product 12 and the second fiber product 14 can be tightly and securely bonded together to form the third fiber product 16.

In an embodiment of the present invention, the first fiber product 12 can be a two-layer fiber product, and the second fiber product 14 is a single-layer fiber product, and thus, the third fiber product 16 is a three-layer fiber product. Further, the first fiber product 12 and the second fiber product 14 are made of paper (or pulp) or nonwoven, while the third fiber product 16 is one of toilet paper, facial tissue, wet tissue, facial membrane, and the likes.

The second liquid pick-up roller 135 and the third liquid pick-up roller 155 are each made of a material that is essentially not deformable, and the second liquid pick-up roller 135 and the third liquid pick-up roller 155 may have a surface that is formed with a plurality of concave portions respectively. For example, the second liquid pick-up roller 135 and the third liquid pick-up roller 155 may be each metal mesh roller. The second liquid application roller 131 and the third liquid application roller 151 are each made of a material that is deformable, for example the second liquid application roller 131 and the third liquid application roller 151 being each a rubber roller.

In an embodiment of the present invention, the first fiber product 12 is a two-layer fiber product, which comprises two single-layer fiber products. The first liquid applying device 11 and the second liquid applying device 13 respectively apply and thus coat the first liquid 112 and the second liquid 132 on the two single-layer fiber products of the first fiber product 12, while the third liquid applying device 15 applies and thus coats the third liquid 152 on a surface of a single-layer second fiber product 14. In other words, the first liquid applying device 11, the second liquid applying device 13, and the third liquid applying device 15 are operable to respectively apply and coat the first liquid 112, the second liquid 132, and the third liquid 152 a surface of each of the single-layer fiber products, so that the liquids can be uniformly distributed and spread over the third fiber product 16 that is formed as discussed above.

In a practical application, the first liquid applying device 11, the second liquid applying device 13, and the third liquid applying device 15 are adjustable for the amounts of the first liquid 112, the second liquid 132, and the third liquid 152 applied thereby. For example, the first liquid application roller 111, the second liquid application roller 131, and the third liquid application roller 151 can be controlled and adjusted in respect of rotating speeds thereof in order to adjust the amounts of application of the first liquid 112, the second liquid 132, and the third liquid 152.

Specifically, the first liquid applying device 11 is arranged upstream of the second liquid applying device 13 and/or the third liquid applying device 15, and the second liquid applying device 13 is located between the first liquid applying device 11 and the third liquid applying device 15, wherein the second liquid application roller 131 is located between the first liquid application roller 111 and the third liquid application roller 151.

In an embodiment of the present invention, the first liquid 112 is first applied by the first liquid applying device 11 to coat on the first surface 121 of the first fiber product 12, and then, the second liquid 132 is applied by the second liquid applying device 13 to coat on the second surface 123 of the first fiber product 12. In a different embodiment, the first liquid applying device 11 and the second liquid applying device 13 are operable to simultaneously apply the first liquid 112 and the second liquid 132 to respectively coat on the different surfaces of the first fiber product 12.

The above is provided only to illustrate a preferred embodiment of the present invention and is not intended to limit the scope of the present invention. Equivalent variations and modifications that fall within the shape, the structure, the feature, and the spirit of the present invention as defined in the appended claims are considered within the scope of the present invention that is solely defined in the appended claims.

What is claimed is:

1. A liquid applying apparatus for fiber products, comprising:

a first liquid applying device including a first liquid application roller that is operable to coat a first liquid on a first surface of a first fiber product, wherein the first liquid applying device comprises a first liquid tank and a first liquid pick-up roller, the first liquid pick-up roller being located between the first liquid application roller and the first liquid tank;

a second liquid applying device including a second liquid application roller that is adjacent to the first liquid application roller, wherein the first fiber product is movable to pass between the first liquid application roller and the second liquid application roller, and the second liquid application roller is operable to coat a second liquid on a second surface of the first fiber product, wherein the second liquid applying device comprises a second liquid tank and a second liquid pick-up roller, the second liquid pick-up roller being located between the second liquid application roller and the second liquid tank; and a third liquid applying device including a third liquid application roller that is adjacent to the second liquid application roller, the third liquid application roller being operable to coat a third liquid on a first surface of a second fiber product, wherein the third liquid applying device comprises a third liquid tank and a third liquid pick-up roller, the third liquid pick-up roller being located between the third liquid application roller and the third liquid tank, and wherein the second liquid application roller is located between the first liquid application roller and the third liquid application roller;

wherein the first fiber product and the second fiber product pass between the second liquid application roller and the third liquid application roller and are pressed together and laminated by the second liquid application roller and the third liquid application roller to form a third fiber product; and wherein the first fiber product is a two-layer fiber product, the second fiber product is a single-layer fiber product, and the third fiber product is a three-layer fiber product with a uniform liquid distribution therein.

2. The liquid applying apparatus according to claim 1, wherein the first liquid application roller, the second liquid application roller, and the third liquid application roller are each a rubber roller.

3. The liquid applying apparatus according to claim 1, wherein the first liquid, the second liquid, and the third liquid have an identical formula.

* * * * *